US009263824B2

(12) United States Patent
Cairns

(10) Patent No.: US 9,263,824 B2
(45) Date of Patent: Feb. 16, 2016

(54) ELECTRICAL CONNECTOR HAVING AN END-SEAL WITH SLIT-LIKE OPENINGS AND NIPPLES

(71) Applicant: Stillwater Trust, Ormond Beach, FL (US)

(72) Inventor: James L. Cairns, Ormond Beach, FL (US)

(73) Assignee: Stillwater Trust, Ormond Beach, FL (US)

( * ) Notice: Subject to any disclaimer, the term of this patent is extended or adjusted under 35 U.S.C. 154(b) by 0 days.

(21) Appl. No.: 14/531,097

(22) Filed: Nov. 3, 2014

(65) Prior Publication Data

US 2015/0340800 A1 Nov. 26, 2015

Related U.S. Application Data

(60) Provisional application No. 62/001,208, filed on May 21, 2014.

(51) Int. Cl.
*H01R 13/52* (2006.01)
*H01R 13/523* (2006.01)
*H01R 24/38* (2011.01)

(52) U.S. Cl.
CPC ..... *H01R 13/523* (2013.01); *H01R 24/38* (2013.01)

(58) Field of Classification Search
CPC ..... H01R 13/52; H01R 13/523; H01R 13/533
USPC ..... 439/271–276, 587
See application file for complete search history.

(56) References Cited

U.S. PATENT DOCUMENTS

| | | | | |
|---|---|---|---|---|
| 3,324,449 | A | 6/1967 | McLoad | |
| 3,508,188 | A * | 4/1970 | Buck | H01R 13/523 439/141 |
| 3,522,576 | A | 8/1970 | Cairns | |
| 3,643,207 | A | 2/1972 | Cairns | |
| 3,729,699 | A | 4/1973 | Briggs et al. | |
| 3,772,636 | A | 11/1973 | Webb | |
| 3,845,450 | A | 10/1974 | Cole et al. | |
| 3,946,805 | A | 3/1976 | Peterman | |
| 3,963,297 | A | 6/1976 | Panek et al. | |
| 4,085,993 | A | 4/1978 | Cairns | |
| 4,142,770 | A | 3/1979 | Butler, Jr. et al. | |
| 4,188,084 | A | 2/1980 | Buresi et al. | |
| 4,373,767 | A | 2/1983 | Cairns | |
| 4,390,229 | A | 6/1983 | Chevalier | |
| 4,529,257 | A | 7/1985 | Goodman et al. | |
| 4,606,603 | A | 8/1986 | Cairns | |
| 4,666,242 | A | 5/1987 | Cairns | |

(Continued)

OTHER PUBLICATIONS

International Search Report and Written Opinion for corresponding International Application PCT/US15/26055, Aug. 4, 2015.

*Primary Examiner* — Chandrika Prasad
(74) *Attorney, Agent, or Firm* — Reed Smith LLP

(57) ABSTRACT

A plug and receptacle electrical connector can be repeatedly connected and disconnected in harsh environments such as seawater. The plug unit has blade-like pins with insulated shafts and conductive tips. The plug unit engages the receptacle unit housing socket contacts within closed, nested, oil-filled chambers. The chambers are pressure balanced to the in-situ environment and to each other and employ positive means to remain sealed before, during, and after mating and demating.

51 Claims, 8 Drawing Sheets

(56) References Cited

U.S. PATENT DOCUMENTS

| | | | | |
|---|---|---|---|---|
| 4,795,359 | A | 1/1989 | Alcock et al. | |
| 4,859,196 | A | 8/1989 | Durando et al. | |
| 4,948,377 | A | 8/1990 | Cairns | |
| 5,171,158 | A | 12/1992 | Cairns | |
| 5,194,012 | A | 3/1993 | Cairns | |
| 5,203,805 | A | 4/1993 | Cairns | |
| 5,334,032 | A * | 8/1994 | Myers | H01R 13/523 439/140 |
| 5,484,296 | A | 1/1996 | Taylor | |
| 5,645,438 | A | 7/1997 | Cairns | |
| 5,645,442 | A | 7/1997 | Cairns | |
| 5,685,727 | A | 11/1997 | Cairns | |
| 5,722,842 | A | 3/1998 | Cairns | |
| 5,738,535 | A | 4/1998 | Cairns | |
| 5,899,765 | A | 5/1999 | Niekrasz | |
| 6,196,854 | B1 | 3/2001 | Hand | |
| 6,315,461 | B1 | 11/2001 | Cairns | |
| 6,332,787 | B1 | 12/2001 | Barlow et al. | |
| 6,464,405 | B2 | 10/2002 | Cairns et al. | |
| 6,561,268 | B2 | 5/2003 | Jones | |
| 6,736,545 | B2 | 5/2004 | Cairns et al. | |
| 6,929,404 | B2 | 8/2005 | Jones et al. | |
| 7,112,080 | B2 | 9/2006 | Nicholson | |
| 7,285,003 | B2 | 10/2007 | Cairns et al. | |
| 7,344,316 | B2 | 3/2008 | MacKinnon | |
| 7,364,448 | B2 | 4/2008 | Cairns et al. | |
| 7,429,193 | B2 | 9/2008 | Cairns | |
| 7,695,301 | B2 | 4/2010 | Mudge, III et al. | |
| 7,794,254 | B2 | 9/2010 | Marklove et al. | |
| 8,192,089 | B2 | 6/2012 | Cairns et al. | |
| 8,292,645 | B2 | 10/2012 | Cairns | |
| 8,376,765 | B2 | 2/2013 | Chaize | |
| 8,702,439 | B1 | 4/2014 | Paulsel et al. | |
| 2002/0123256 | A1 * | 9/2002 | Brickett | H01R 13/533 439/140 |
| 2008/0274636 | A1 * | 11/2008 | Marklove | H01R 13/521 439/271 |
| 2014/0096992 | A1 * | 4/2014 | Williams | E21B 33/04 174/20 |

* cited by examiner

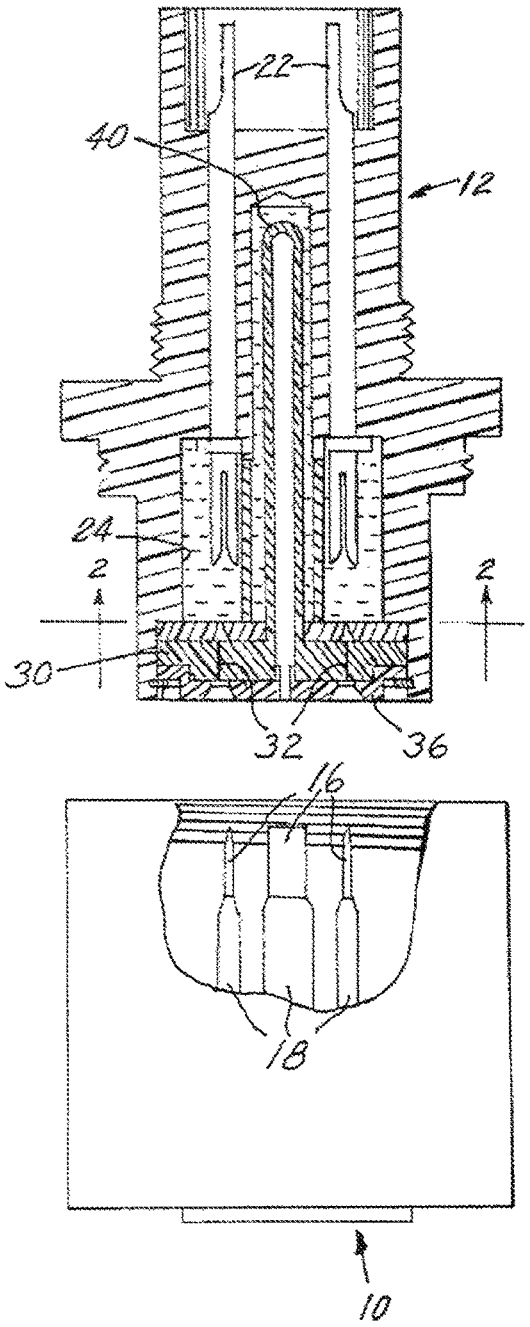
FIG. 1
FIG. 2
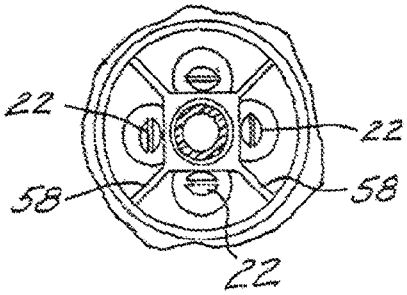
FIG. 3
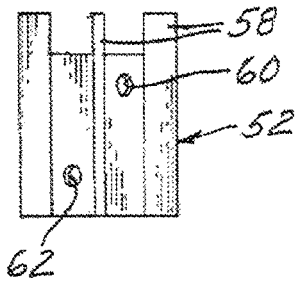
Prior Art

ELECTRICAL CONNECTOR HAVING AN END-SEAL WITH SLIT-LIKE OPENINGS AND NIPPLES

CROSS-REFERENCE TO RELATED APPLICATION

This application claims the benefit of the earlier filing date of, U.S. Provisional Patent Application No. 62/001,208, filed on May 21, 2014, the entire contents of which are incorporated herein by reference.

FIELD OF THE INVENTION

Embodiments of the invention relate to an apparatus for connecting and disconnecting electrical circuits underwater or in other harsh environments.

BACKGROUND

The first rudimentary electrical connectors that could be connected and disconnected underwater appeared in the mid-1960's, with reliable commercial products not becoming available until the mid-1980's. Prior to that time, subsea systems had to be fully connected electrically before submersion. In the intervening years many Offshore Industry applications have been developed that require electrical elements to be repeatedly connected and disconnected while immersed in seawater. There are several known devices that fulfill that requirement. A subset of such devices comprises connectors wherein the electrical contacts consist of pins and sockets to be joined in a chamber filled with a benign substance that protects them from the external environment. The protective substance, a mobile dielectric material such as oil, grease, or gel, hereinafter referred to simply as fluid or oil, is pressure-balanced to ambient in-situ conditions by way of a compensating element which is typically a flexible wall of the chamber in which it is housed. Representative examples of the prior art can be found in U.S. Pat. Nos. 3,508,188; 3,522,576; 3,643,207; 4,085,993; 4,142,770; 4,373,767; 4,795,359; 4,948,377; and 5,171,158.

In this subset of prior-art underwater connectors the pins generally have elongated electrically-conductive shafts that are coated with dielectric sheaths, and have exposed electrically conductive contact tips. The pins enter the contact chamber by way of penetrable end-seal passages that are intended to remain sealed from the outside environment before, during, and after mating and de-mating. Once mated, the conductive pin-tips are completely immersed within the contact chamber, leaving a portion of the electrically insulated shafts exposed to the in-situ environment. For ease of discussion, the connector unit in which pins are housed shall hereafter be referred to as the "plug," and the unit housing the sockets within the mating chamber shall be referred to as the "receptacle."

It is a challenge to keep the receptacle end-seal passages leading into the oil chamber closed before, during, and after mating and de-mating. To meet that challenge, connectors that represent this subset and are currently commercially available have evolved into complex devices having plug pins with circular cross sections, and receptacles with resilient end-seals having circular, re-sealable passages to accept the respective cylindrical pins. Currently on the market there are connectors employing one or the other of two different approaches for keeping the cylindrical, bore-like end-seal passages sealed at all times.

In the first approach, when the connector portions are unmated the elastomeric receptacle end-seal passages are occupied by rigid, non-electrically-conductive, cylindrical stoppers housed within the mating chamber. The stoppers are biased outward by robust springs. During mating, the entering plug pins force the stoppers inward beyond the end-seals and further into the mating chamber, thereby compressing the springs. The result is that the receptacle mating-chamber end-seal passages are always occupied, either by the stoppers when unmated, or by the plug pins when mated. That keeps the circular end-seal passages always sealed from the outside environment, but it does so at the expense of a great deal of complexity. The springs must be robust to guarantee reliable return of the stoppers into the end-seal passages upon demating. That creates substantial mating forces, and requires a latching mechanism or other means to keep the connector portions from springing apart once mated. And even though the return springs are robust, failures occasionally occur when the spring-driven stoppers fail to return outward into the end-seal passages. That leaves a leak path between the chamber fluid and the in-situ environment. A representative example of this sort of connector is found in U.S. Pat. No. 4,948,377.

The second, less reliable approach to the circular end-seal closure challenge is to pinch resilient, tubular, end-seal passages closed when the connector portions are unmated. The force required to keep the circular tubular passages pinched closed is provided either by an elastomeric sphincter surrounding the passage, or by a metal spring, or by both a spring and an elastomeric sphincter acting together. Upon mating, the pinched tube is forced open by a slender, tapered end of the circular cross-section incoming plug pin; thus remaining sealed against the plug pin's surface during mating and de-mating, and while mated. One example of this sort of connector is found in U.S. Pat. No. 4,373,767. The invention has no stoppers or stopper-biasing springs, and therefore is mechanically much simpler than connectors built around the concept mentioned in section [005]. It has major disadvantages however: the substantial force required to pinch a circular end-seal passage completely closed makes mating and de-mating difficult, sometimes resulting in tearing of the tubular passage, and subsequent failure. The construction has the further disadvantage of failure of the circular tubular passages to close properly after prolonged mating at cold temperature. When that happens a leak path is created between the chamber oil and the in-situ environment, for instance electrically conductive seawater. In addition, the high stress required of such end-seals is detrimental to the seal's elastomeric properties. All of these disadvantages compromise the reliability of this sort of connector.

There is third, completely different, approach which is not currently on the market. The early technology disclosed in U.S. Pat. No. 3,643,207 approached the connector seal-closure problem in a much less complex way. Instead of attempting to keep circular bore-shaped resilient passages closed, it employed one narrow, slitted passage through an elastomeric receptacle end-seal for each respective one blade-like plug pin. Little or no end-seal material was removed in creating the slits. A slit is much easier to keep closed than a cylindrical bore because it is closed in its natural unstressed condition. A blade-like pin causes little distortion of a properly-sized slitted opening, and only slight stress on the elastomeric seal material. Although the blade-in-slit sealing concept itself is very sound, connectors incorporating that approach lacked the necessary attributes to function reliably. For example, the only mechanism provided to close the slits was the elasticity of the resilient end-seal material through which the slits were cut. Upon demating after prolonged mating at cold temperatures the slits closed very slowly, allowing a temporary leak path between the chamber fluid and the in-situ environment. When that happened, the chamber fluid became contaminated by intruding environmental fluid such as seawater, thereby degrading its electrical properties. No positive means were included to isolate conductive elements within the chamber fluid from each other, so intruding contaminants occasionally caused electrical circuit-to-circuit internal breakdown. For those and other reasons the concept was abandoned years ago in favor of the aforementioned more complex approaches.

In addition to the fact that all of the aforementioned products have some technical shortcomings, the complexity and expense of the underwater connectors described in paragraphs [005] and [006] puts them out of reach of many, if not most, harsh environment projects. Those described in paragraph [007] never resulted in viable commercial products. What is still needed is a connector device that reduces or overcomes the shortcomings found in the known harsh environment connectors as described above, while simultaneously reducing the complexity and cost of manufacture. This invention fulfills that need.

SUMMARY

Invention embodiments described herein provide for an apparatus which includes a first connector unit hereafter called the "plug" and a second connector unit hereafter called the "receptacle" which can be repeatedly connected and disconnected underwater or in other harsh environments without loss of electrical integrity. Although the described embodiments are intended for use subsea, is clear that they could be used in myriad applications wherein the electrical junctions, when connected, must remain sealed from each other and from the in-situ environment; and when disconnected, receptacle contacts must remain electrically isolated from each other and from the in-situ environment.

In one embodiment of the invention the plug unit houses a first one or more electrical "pins" characterized by elongated, blade-like, insulated shafts with exposed electrically-conductive tips. The receptacle unit houses a respective one or more electrical "sockets" housed in a chamber filled with a mobile dielectric substance sealed from the exterior environment. When the plug and receptacle units are joined, the one or more plug pins sealably penetrate respective one or more slitted passages into the receptacle chamber, their conductive tips thereby joining the respective one or more socket contacts within the oil-filled receptacle chamber. Active closure means which augment the resiliency of the slitted passages are provided to urge the passages seaiably closed before, during, and after mating and demating.

BRIEF DESCRIPTION OF THE DRAWINGS

The invention is presented herein in general terms without regard to any specific application. It will be easily understood that the described apparatus can be readily adapted to a wide variety of housings, contact arrangements, sizes, materials, and exterior configurations, making it adaptable to a broad spectrum of applications.

Other features and advantages of the present invention will become more readily apparent to those of ordinary skill in the art after reviewing the following detailed description and the accompanying drawings, in which like reference numbers refer to like parts:

FIG. 1 is a partial axial cross-sectional view of old art taken from U.S. Pat. No. 4,085,993;

FIG. 2 is a cross-section taken through 2-2 of FIG. 1;

FIG. 3 shows a dividing element of the U.S. Pat. No. 4,085,993 receptacle;

DETAILED DESCRIPTION

Figures 4A, 4B:
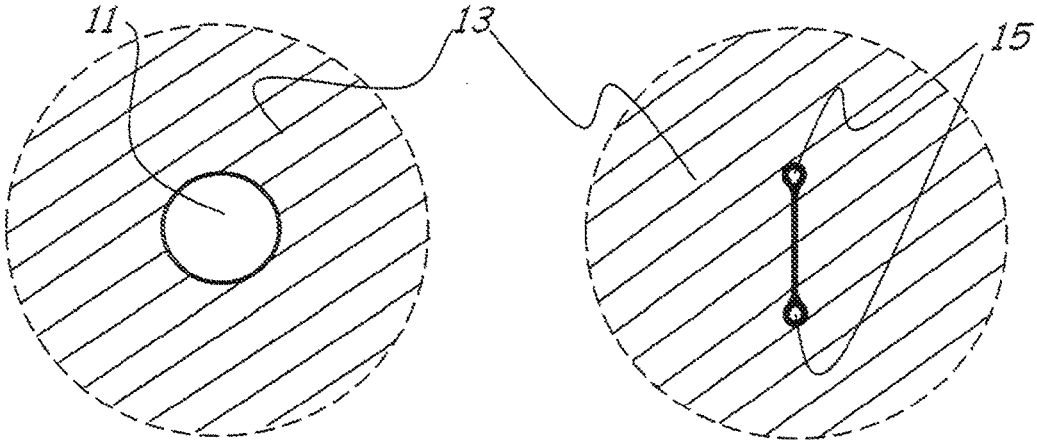
FIGS. 4*a* and 4*b* show various seal radial cross-sections.

FIGS. 1, 2, and 3 are examples of old art taken from U.S. Pat. No. 4,085,993 in which FIG. 1 is a partial axial cross-section of plug connector unit 10 and receptacle connector unit 12. Plug unit 10 has blade-like pins 16 whose shafts are coated by a thin dielectric material 18. Receptacle unit 12 has respective electrical sockets 22 housed in chamber 24. Chamber 24 is filled with a dielectric fluid such as Silicone oil. Resilient disc 30 is perforated by slits 32 through which respective plug pins 16 sealably pass during mating and demating. Boot 40 communicates with the in-situ environment by way of a central bore in plate 36, thus equalizing the dielectric fluid pressure within chamber 24 to that exterior to receptacle connector unit 12.

The '993 construction lacks a number of essential aspects whose absence causes the connector units to be ineffective. As an example, no means other than the resiliency of disc 30 is provided to close the slitted openings upon demating. Therefore, upon disconnection of the plug and receptacle units, the only force available to reclose slits 32 is the elasticity of the resilient material from which disc 30 is made. Even the most elastic materials when deformed for long periods of time, and particularly in a cold environment, will not snap back to their original shape when urged to do so only by their inherent elasticity. They return slowly, if at all. That slow return, in the case of slitted passages 32, allows in-situ fluid such as seawater to enter fluid chamber 24 and contaminate the fluid therein; and, it allows the chamber oil to leak out. Vanes 58 with holes 60, 62 seen in FIGS. 2, 3 retard the electrical shorting of adjacent receptacle contacts due to such contamination, but they do not prevent it. Another problem with relying solely upon the seal material's elasticity to close the slits is that, to be even minimally effective, the seal material must be extremely elastic. But known very elastic materials such as natural rubber have little resistance to degradation by sunlight and chemicals, and so can only be used in a limited number of applications.

A further disadvantage of relying solely upon the elastomeric properties of disc 30 to keep slits 32 sealably closed under all circumstances is that even a modest pressure differential between the fluid in chamber 24 and the exterior environment causes the slits to weep. Almost invariably in fluid-filled connector units there is at least a small quantity of air entrapped within the oil-filled mating chamber typified by '993 chamber 24 when it is initially filled with fluid. Unless the air is excessive, that is no problem; when the units are subjected to high external pressure the air collapses and eventually goes into solution. Boot 40 or its equivalent expands to compensate for the air's absence. The amount of compensation required cannot exceed that of the volume of air that was entrapped when the oil-filled mating chamber was initially filled. In contrast, when exposed to high temperature and/or low in-situ pressure the air expands. There is a practical limit to how much air can compress, but no such limit on how much it can expand. Expanding air within the oil-filled mating chamber causes boot 40, or its equivalent to collapse to its limit, after which the expanding air within the oil chamber results in fluid leakage through slitted openings typified by 32. The now defunct '993 connector units, whose seals relied solely upon their resiliency to keep the slitted passages closed, could not be shipped by air without losing fluid. They often arrived at their destinations unfit for use.

One design goal for high-reliability fluid-filled connectors is that chambers wherein the pin-socket contacts are joined must be at least doubly sealed both from the in-situ environment, and from the mating chambers of other pin-socket pairs within the connector. Connectors with blade-like plug pins and slitted-passage receptacle seals typified by U.S. Pat. Nos. 3,643,207 and 4,085,993 do not satisfy that goal. Aside from vanes 58 which limit contamination migration, there are no means to doubly seal individual pin-socket pairs from each other or from the in-situ environment. As a result, seawater ingress into chamber 24 from one slitted passage can migrate to electrically bridge the gap between pin-socket pairs within the chamber causing electrical breakdown. In the case of a damaged passage 32, a direct conductive seawater path can exist to the outside environment, allowing electrical shorting to the seawater. The lack of redundant sealing renders all prior art connectors employing slitted-passage receptacle end-seals unacceptable for high-reliability applications.

FIGS. 4*a* and 4*b* illustrate some problems associated with the U.S. Pat. No. 4,373,767 technique of sealing a circular cross-section passage 11 through a resilient end-seal 13 by pinching it closed. It requires considerable force to pinch the circular passage 11 of FIG. 4*a* into the partially closed shape shown in FIG. 4*b*. Completely closing the passage at end points 15 in FIG. 4*b* would result in very high stress of the seal material at the ends of the pinched opening. Also, the required pinching force makes the insertion and subsequent withdrawal of a cylindrical plug pin difficult and potentially harmful to the seal. When elastomers are forcibly pressed against rigid surfaces for long periods of time they conform to irregularities on those surfaces on a microscopic scale, and no longer slide against them easily; they adhere.

Figures 5A, 5B:
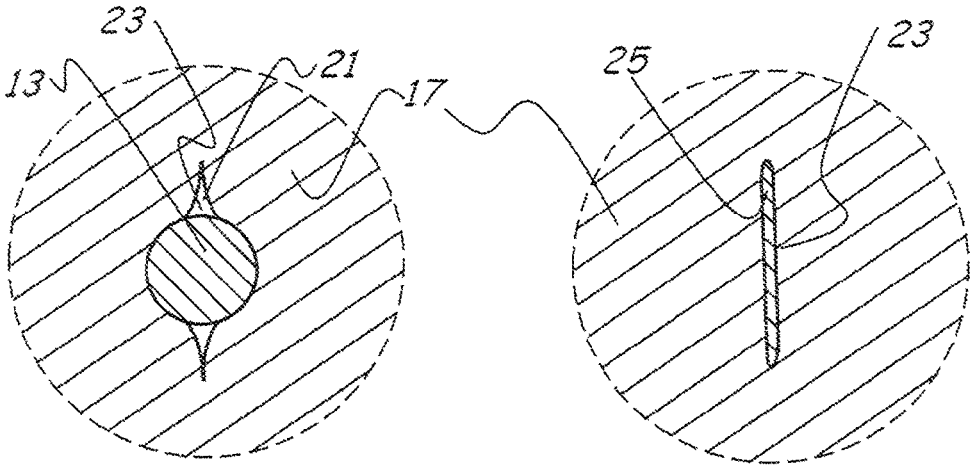
FIGS. 5*a* and 5*b* show various pin radial cross-sections in slitted openings.
Figures 6A, 6B, 6C:
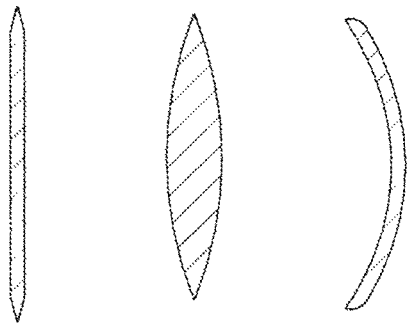
FIGS. 6*a*, 6*b*, and 6*c* indicate potential cross-sections for blade-like pin contacts.

FIG. 5*a* demonstrates why it is not practical to use circular cross-section pins with slitted seal passages. FIG. 5*a* is a radial cross-section through a portion of seal 17 with a slitted passage 23 and a round cross-section pin 19 within the passage. The passage walls do not conform well to the pin, leaving unsealed leak paths 21. Leak paths 21 could only be completely closed if seal 17 were either highly compressed onto the pin or grossly stretched around the pin, but either of those would make insertion and subsequent withdrawal of the pin very difficult due to adherence, possibly damaging the seal. In contrast, FIG. 5*b* shows a blade-like pin 25 passing through the slitted passage 23 in seal 17. The blade is able to conform to the passage walls, and with only minimum stretch of seal 17 leaves no leak path. Blade-like pins require relatively little force to penetrate or be withdrawn from the seal's slitted passage. "Blade-like" pins are not required to be of simple flat-sided cross-section as shown in FIG. 5*b*. They can be of any elongated cross-sectional shape that fills an elastomeric slitted passage without creating high stress on the seal. Some of the many examples of pin cross-sectional shapes that could be used with slitted passages are shown in FIGS. 6*a*, 6*b*, and 6*c*. For example FIGS. 6*b* and 6*c* show that the pins do not necessarily have to have either a constant width or parallel sides. In the case of the FIG. 6*c* blade contact, the chamber's slitted end-seal opening to would be crescent shaped in order to sealably receive it. Many other functional shapes could be devised.

Figure 7:
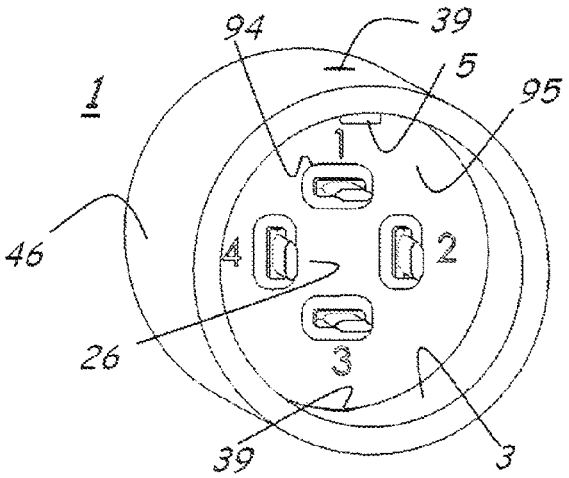
FIG. 7 is an oblique view of connector unit 1.
Figure 8:
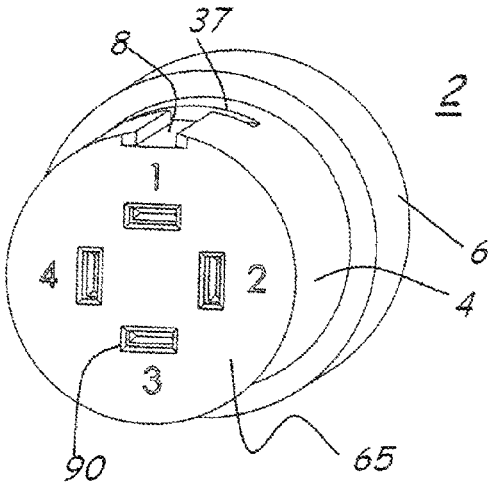
FIG. 8 is an oblique view of connector unit 2.
Figure 9:
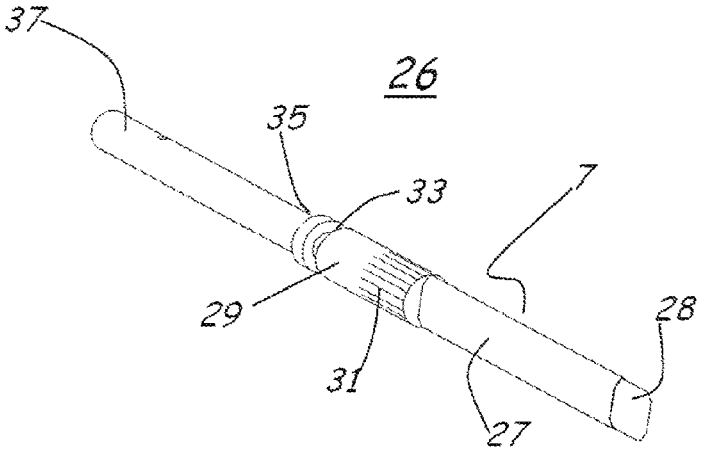
FIG. 9 is an oblique view of a plug electrical contact 26.

FIGS. 7, 8 and 9 illustrate respectively embodiments of plug unit 1, receptacle unit 2, and typical plug pin 26 of the invented connector. Outer shell 46 of plug 1 has cylindrical bore 3 sized to receive forward cylindrical projection 4 of receptacle shell 6. During and after mating of the units, bore 3 in cooperation with projection 4 serve to keep the units axially aligned. Plug shell vent holes 39 permit free flow of the in-situ environmental material, for instance seawater, into and out of plug bore 3 during mating, de-mating, and thereafter. Key 5 of plug shell 46 cooperates with keyway 8 of receptacle shell 6 to rotationally lock plug 1 to receptacle 2. Lateral slot 37 at the end of keyway 8 serves as a cleanout for debris that otherwise might block the free entrance of key 5 into keyway 8. Plug pins 26 comprise blade-like shafts 7 with dielectric sheaths 27, exposed conductive tips 28, cylindrical sections 29 with knurled surfaces 31, o-ring grooves 33, rear shoulders 35, and solder cups 37. Pins 26 project outward into plug bore 3. Openings 90 in receptacle end wall 65 are positioned to receive respective plug pins 26.

Figure 10:
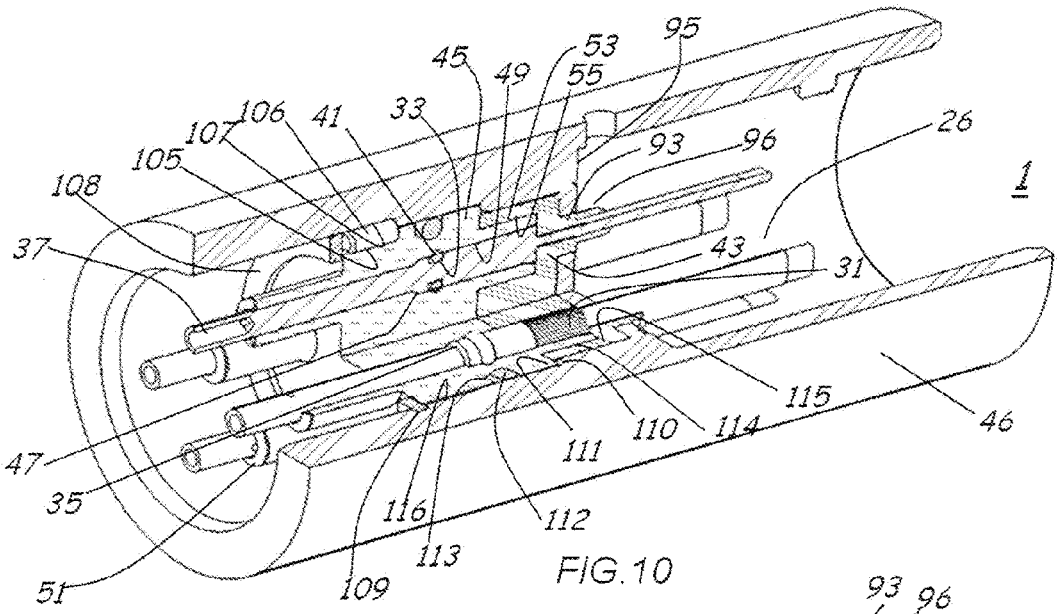
FIG. 10 is an oblique axial quarter-section view of connector unit 1.

FIG. 10 depicts an axial quarter-section of plug 1. Pins 26 are press fit into bores 49 in plug base 45 until plug pin rear shoulders 35 seat against respective shoulders 47 of plug base 45. 0-rings 41 seat in grooves 33 effectively sealing the interface between plug base 45 and plug pins 26 Plug base 45 can be made from an engineered plastic material such as glass reinforced Ultem. Knurled plug-pin surfaces 31 have an interference fit to diameters 49 of plug base 45, thereby rotationally locking plug pins 26 to base 45, Shoulders 47 in base 45 acting in cooperation with plug pin shoulders 35 limit the rearward travel of the plug pins within base 45. Once the plug pins are fully inserted into plug base 45, retainer rings 51 are put in place thereby fixing the pins axially within the plug base. Plug forward resilient seal 43 shown partially cut away in FIG. 11 has inner bores 55 that seal to cylindrical projections 53 of plug base 45, FIG. 10 shows plug alignment key 106 acting with keyway 105 in plug base 45 and with keyway 107 in plug shell 46 to rotationally lock plug base 45 to plug shell 46. Retainer ring 108 seats in groove 109 in plug shell 46 to axially limit the rearward travel of plug base 45 within plug shell 46. Shoulder 110 of plug shell 46 in cooperation with shoulder 111 of plug base 45 limits the forward travel of plug base 45 within plug shell 46, O~ ring 112 seated in groove 113 of plug base 45 seals the interlace between base 45 and bore 116 of plug shell 46. Forward portion 114 of plug forward resilient seal 43 sealable fits to bore 115 of plug shell 46 thus providing a backup seal for O~ ring 112.

Figures 12A, 12B:
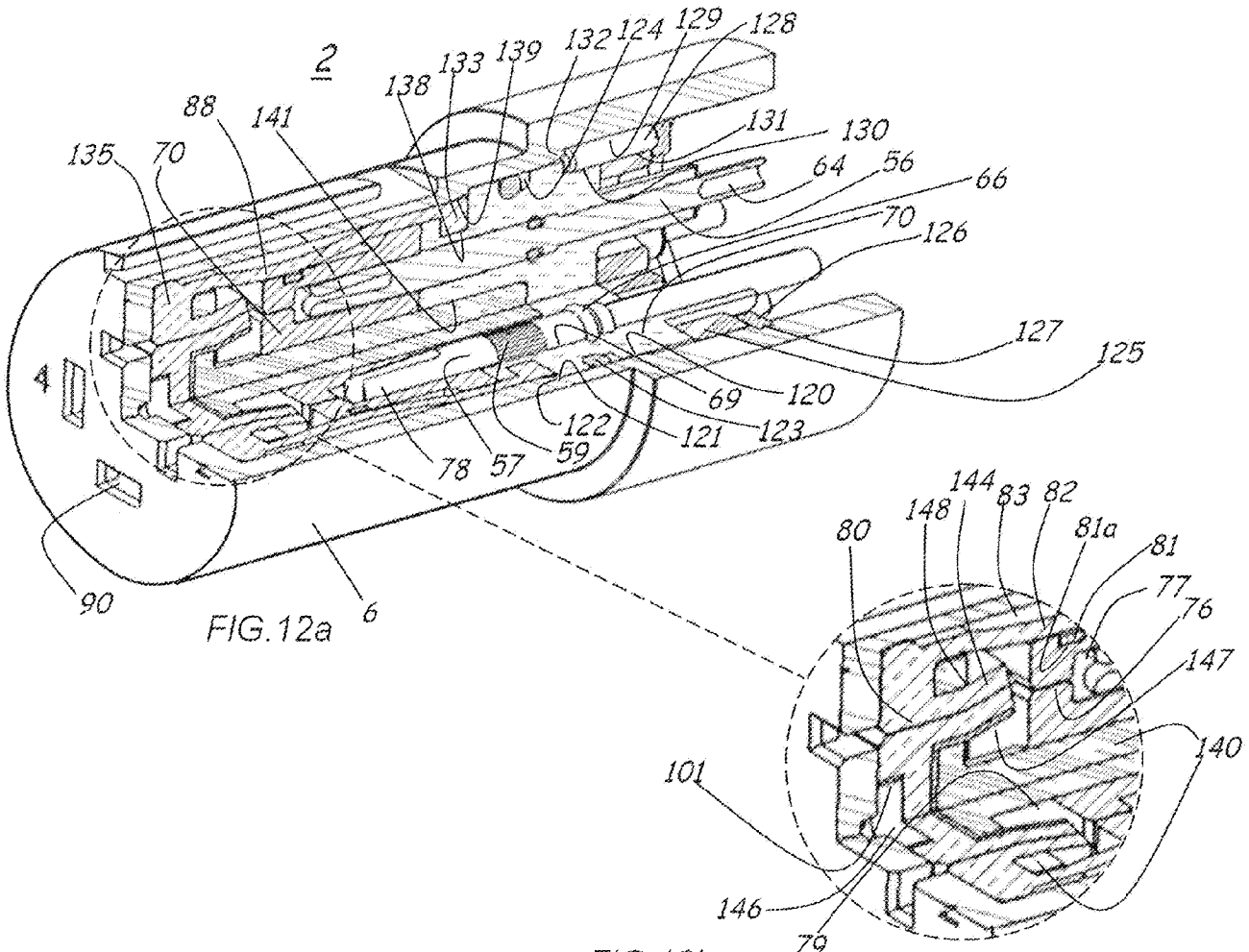
FIGS. 12*a* and 12*b* are oblique axial quarter-section views of connector unit 2.

Receptacle unit 2 is shown in axial quarter-section in FIGS. 12*a* and 12*b*. Receptacle base 70 inserts into bore 120 of receptacle shell 6. The forward movement of base 70 within shell 6 is arrested by the cooperation of shoulder 121 of base 70 with shoulder 122 of shell 6. The interface between base 70 and bore 120 of shell 6 is sealed by o-ring 123 which seats in groove 124 of base 70. High-strength barrier 125 fits in bore 120 rearward of base 70. High-strength barrier 125 serves to prevent damage to connector receptacle unit 2 that might otherwise result from high differential pressure across base 70. Barrier 125 can be made from high-strength plastic for light duty applications, or from a variety of metals for heavy duty service. Both barrier 125 and base 70 are restrained from rearward movement within shell 6 by retainer ring 126 in groove 127 of receptacle shell 6. Key 128 acting with keyways 129, 130, and 131 rotationally aligns base 70 and high-strength barrier 125 to receptacle shell 6. Key 128 is held in place axially by retainer ring 126 and by the forward end 132 of keyway 129 of shell 6.

Figure 13:
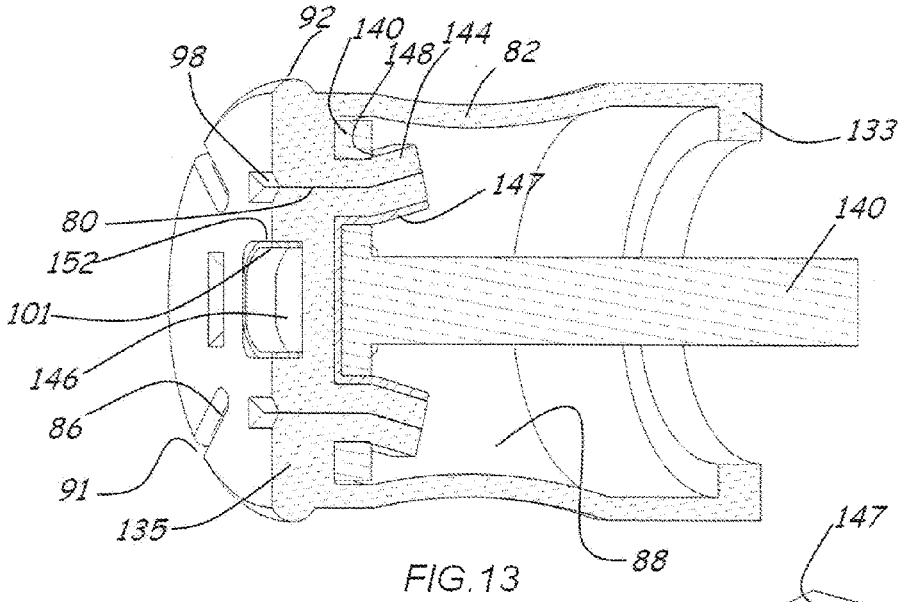
FIG. 13 is an oblique axial half-section view of receptacle internal components including the end-seal 88, end-seal standoff 140, and leaf spring 147.

Receptacle end-seal 88 shown in FIGS. 12*a* and 13 consists of flexible wall 82 which terminates on its posterior end with inward facing shoulder 133 and on its anterior end by wall 135. Shoulder 133 of end-seal 88 seats in groove 138 of receptacle base 70 thereby sealing the interface between base 70 and end-seal 88. The exterior surface of end-seal 88 at shoulder 133 also seals the interface between the rear portion of end-seal 88 and forward bore 139 of shell 6, thereby providing a redundant seal to o-ring 123. Segmented nibs 92 projecting radially outward from wall 135 serve to radially center wall 135 within forward bore 139 of receptacle shell 6, and serve to keep resilient wall 135 from squirming radially outward during mating.

Figure 14:
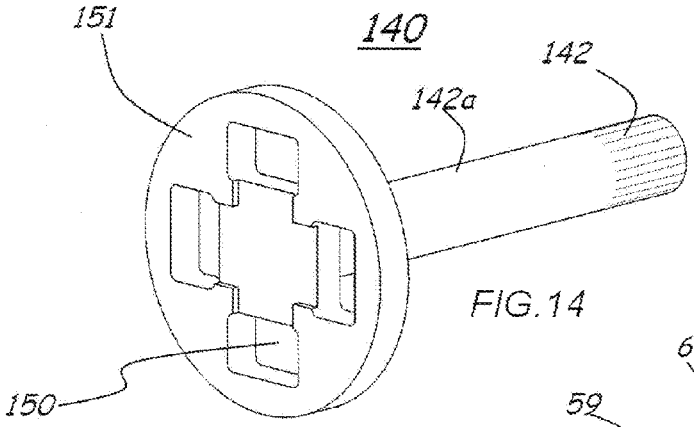
FIG. 14 is an oblique view of receptacle end-seal standoff 140.

End-seal standoff 140 shown in Figures 10, 13, and 14 has a knurled posterior end 142 that press fits into socket 141 of receptacle base 70. The knurl rotationally locks standoff 140 to base 70. Standoff 140 maintains end~ seal 88 in axial position relative to receptacle shell 6. hurl~ seal 88 Shown clearly in FIGS. 12*a* and 13 has one or more inward projecting sleeves 144 each with respective slitted passage 80. Openings 150 in end wall 151 of standoff 140 are shaped and spaced to pass respective inward-projecting sleeves 144 through the end wall when assembled. End wall 135 of end~ seal 88 is rotationally positioned within receptacle unit 2 by sleeves 144 in cooperation with openings 150 in standoff 140. Standoff 140 can be made from a high strength plastic material such as glass reinforced Ultem. Passages 80 in end wall 135 of end~ seal 88 extend inward from respective shaped seal scats 98 and thence completely through sleeves 84, thus permitting the insertion of shafts 7 of plug pins 26 through respective seal passages 80 and onward into oil chamber 79.

The invention maintains a seal between receptacle fluid chamber 79 and the in-situ operating environment at all times. It does so while exerting only a minimum amount of squeeze of receptacle resilient end-seal 88 against the shafts 27 of plug pins 26. As described earlier, any more than a slight squeeze would cause the resilient material of slitted passages 80 to adhere to the shafts of respective pins 26 after prolonged periods of mating. That, in turn, could damage the passages and result in unacceptably high demating threes. The invention utilizes active closure means that augment the resiliency of end-seal 88 to urge passages 80 sealably closed. In the presently described embodiment there are two such active closure means, each comprising a unique spring construction. The first-described active closure means utilizes circular spring 101, seen clearly in FIGS. 12*b* and 13, which seats in rectangular recess 146 in end wall 135 of end-seal 88. Spring 101 can be made, for instance, from a flexible plastic such as Ryton which is resistant to both a wide variety of chemicals and to seawater. Circular spring 101 is slightly distorted radially inward by flat sides 152 of recess 146 thereby exerting a light outward force on flat sides 152 that in conjunction with nibs 92 acting against bore 139 provide a means auxiliary to the resiliency of end wall 135 to urge the seaward portions of slitted passages 80 sealably closed when connector units 1 and 2 are unmated. The seaward portions of slitted passages 80 are gently urged together by spring 101.

Figure 15:
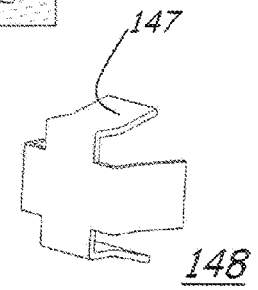
FIG. 15 is an oblique view of the receptacle leaf spring 147.

The invention's second active closure means provided to augment the resiliency of end-seal 88 in urging slitted passages 80 sealably closed utilizes respective outward biased tines 147 of leaf spring 148 shown most clearly in FIGS. 13 and 15. Leaf spring 148 can be made from plastic material such as Ryton. Tines 147 do not work by pressing opposed sides of slitted passages 80 together, as circular spring 101 does. Instead, leaf-spring tines 148 kink respective resilient sleeves 144, which are axially straight in their relaxed condition, laterally outward across respective edges 148 of openings 150 of standoff 140. Kinking passages 80 closes them without putting any more than very slight compression on sleeves 144, thus allowing insertion and withdrawal of plug pins 26 with minimum force, and with minimum stress on the resilient sleeve material. When shafts 7 of plug pins 26 are inserted into respective passages 80 they straighten sleeves 84, concurrently flexing respective leaf-spring tines 147 laterally inward. Upon demating, as plug pins 26 are withdrawn from receptacle end-seal passages 80, they first pass outward of the inner projections 144 of end-seal 88. As they do, leaf-spring tines 147 flex radially outward thereby kinking passages 80 closed. The interface between the in-situ seawater and the chamber oil is sealed at that point. Further withdrawal of plug pins 26 to the point where they exit slitted openings 80, allows circular spring 101 to actuate outward closing the seaward entrances to slitted openings 80. The end result is that passages 80 are completely sealed and seawater free. The invented connector would function in the absence of either circular spring 101 or leaf-spring tines 147, but incorporating both components results in a more reliable product with minimum total squeeze on plug pins 27 when mated, and minimum demating force.

Figure 16:
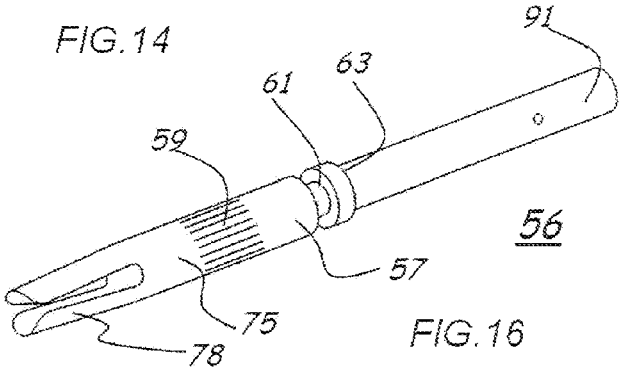
FIG. 16 is an oblique view of a receptacle electrical contact 56.

Typical receptacle socket contacts 56 shown in FIGS. 12*a* and 16 comprise cylindrical sections 57 with partially knurled surfaces 59, and O~ ring grooves 61, rear shoulders 63, and solder cups 64. O~ rings 66 seated in grooves 61 seal the interlaces between receptacle socket contacts 56 and respective be 69 of receptacle base 70. Socket contacts 56 are press fit into bores 69 in receptacle base 70 to the point where receptacle socket contact rear shoulders 63 seat against respective shoulders 71 of receptacle base 70. Knurled receptacle socket contact surfaces 59 have an interference fit to diameters 69 of receptacle base 70, thereby rotationally locking receptacle socket contacts 56 to base 70. Shoulders 71 acting hi cooperation with receptacle socket contact shoulders 63 limit the rearward travel of the receptacle socket contacts within base 70. Base 70 can be made from a high~ strength plastic such as glass reinforced Ultem. Once the receptacle socket contacts are fully inserted into receptacle base 70, retainer rings 72 are put in place, thereby fixing socket contacts 56 axially within the receptacle base. Receptacle inner resilient seal body 73 shown partially cut away in FIGS. 12*a* and 17 has inner bores 74 that are sealed on their posterior ends by resilient seal body 73 acting against cylindrical portions 75 of socket contacts 56, and on their anterior ends by closed slit-like openings 76 through resilient seal body 73 thereby creating closed inner chambers 77, seen in FIG. 12*b* , wherein respective socket contact tines 78 are housed. The one or more closed inner chambers 77 housing respective contact tines 78 are, in turn, housed within outer chamber 79. Bore 74*a* through seal body 73 is lightly stretch~ fit to smooth portion 142*a* of standoff 140, thereby sealing the interface between them. Wall 82 of receptacle end~ seal 80 is sealably pressed between shoulder 153 of inner resilient seal body 73 and inner diameter 139 of receptacle shell 6 thereby isolating interface 154 from communication with any contaminants within the fluid of chamber 79. Such contaminants, seawater for instance, could otherwise migrate from chamber 79 into interface 154 causing degradation of the electrical isolation between adjacent receptacle contacts 56. Outer chamber 79 and one or more inner chambers 77 arc all filled with oil and sealed from each other. Outer chamber 79 is sealed from the in-situ environment by One or more closed suited passages 80, The one or more slit~ like openings 76 seal respective inner chambers 77 from outer chamber 79. axially forward would create a vacuum at interface 139 whose tendency would be to suck 73 back into place.

Figure 17:
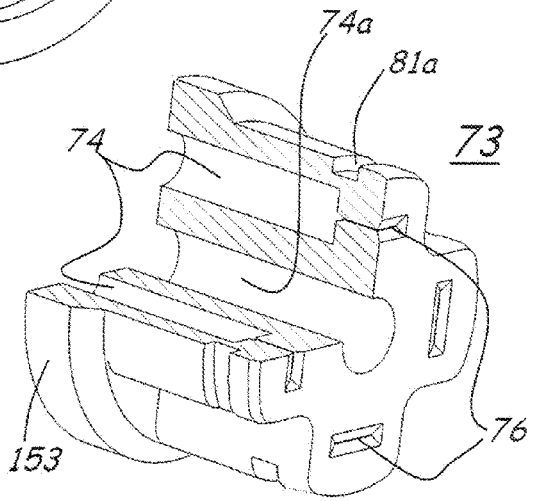
FIG. 17 is an oblique axial quarter-section view of resilient seal 73.

Referencing FIGS. 12*b* and 17, the one or more slit-like openings 76 that seal respective inner chambers 77 have active closure means consisting of constrictive band 81 seated in groove 81*a* of seal body 73 that augments the resiliency of inner seal body 73 to urge the slit-like openings sealably closed. Constrictive band 81 can be an elastomeric band or a garter spring, for instance. In keeping with the earlier discussion of minimizing the squeeze against plug pins 26, the constrictive force is slight; that's all that's needed.

Figure 18:
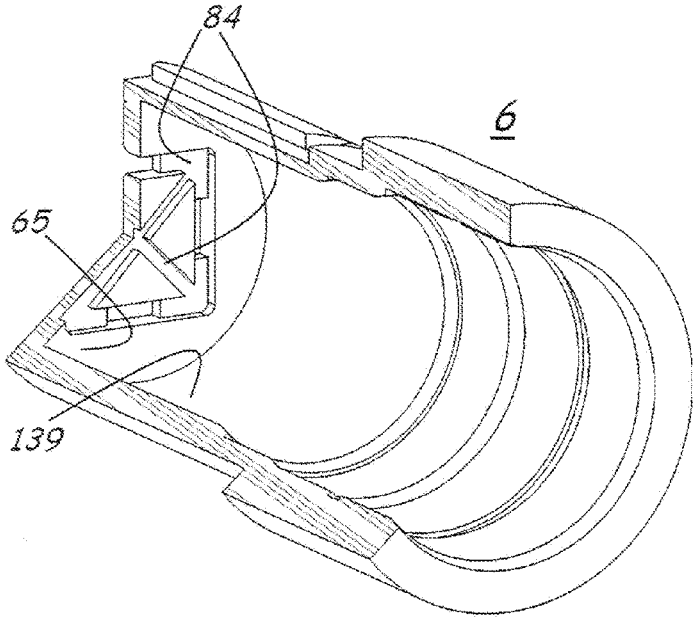
FIG. 18 is an oblique axial sectional view of receptacle shell 6.

When plug pins 27 enter outer and inner fluid-filled chambers 79, 77 the fluid volume they displace must be accompanied by an enlargement of the chamber volumes in order to keep the internal pressure constant. By the same reasoning, when pins 27 are subsequently withdrawn from chambers 79, 77 the chamber sizes must reduce to account for the withdrawn volume. Similarly, when the in-situ environmental pressure changes, the inner chamber 77 and outer chamber 79 volumes must change in order to balance their internal pressure to that of the outside environment. Those volume changes require some element of the chambers to move, thereby altering their size. In the invention, the movable elements in both the inner and outer chambers are resilient portions of the chambers. The fluid within individual inner chambers 77 is substantially pressure balanced to the pressure within outer chamber 79 by the resiliency of inner seal 73. The pressure within outer chamber 79 is approximately balanced to the in-situ environmental pressure by way of outer chamber resilient wall 82. Space 83 between receptacle shell 6 and outer chamber resilient wall 82 is freely vented to the exterior environment by a network of channels 84 incised into the inside of end wall 65 of receptacle shell 6 as shown in FIG. 18. Channels 84 are in direct communication the in-situ environment through openings 90 in end wall 65. Referencing FIGS. 13 and 18, channels 84 on the inside of receptacle shell end wall 65 connect to other channels 86 molded into the anterior face of receptacle end-seal 88, which channels, in turn, lead to gaps 91 in radially outward projecting nib 92 of end-seal 88. Gaps 91 communicate directly with space 83 that surrounds wall 82 of end-seal 88.

Figure 11:
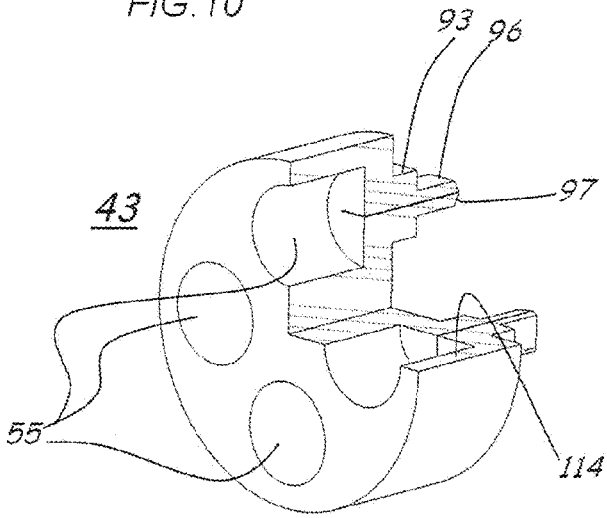
FIG. 11 is an oblique axial quarter-section view of resilient seal 43.

Resilient plug end~ seal 43, shown in FIGS. 7, 10, and 11, has a forward projecting second nipple 96 for each respective plug pin 26 the second nipples comprising a forward projection 96 of each respective first nipple 93. Second nipple 96 have shaped ends 97 which, when plug unit q and receptacle unit 2 are mated, press conformably and sealably into shaped seats 98 in resilient receptacle end~ seal 88 shown in FIG 13, thus forming first respective sealing barriers for receptacle oil chamber 79 when connector units 1 and 2 are mated. These repective sealing barriers ensure that, as opposed to prior art constructions, no portions of shafts 7 of plug pins 26 are exposed to the in-situ environment when connector units 1 and 2 are mated. U.S. Pat. No. 3,643,207has a similar construction; however the corresponding sealing barriers are formed between projecting resilient nipples at the bases of the plug pins and shaped openings in the hard faceplate of the receptacle. If mated submerged, that construction traps portions of the in-situ environment within the small uncompensated volumes defined laterally by the shaped faceplate openings and axially by the space between respective resilient plug nipples and the resilient end-seal of the receptacle unit. Thus there remains, undesirably, a portion of the insulated plug-pin shafts exposed to a small amount of in-situ environmental fluid even when the connector units are mated. If the '207 units were instead mated before submersion, the small uncompensated trapped volumes would be urged to collapse by the ambient pressure, thereby possibly rendering the units difficult to demate, or damaging them, or simply sucking fluid into them either from the oil chamber or from the external environment, Referencing FIGS. 7, 11, 19*a* and 19*b*, plug forward projecting second nipples 96 pass through, but do not seal to respective openings 90 in end wall 65 of receptacle shell 6 when plug unit 1 and receptacle unit 2 are mated. Furthermore, when sr i-d the units are mated a gap 100 remains between respective plug end wall 95 and receptacle end wall 65. Gap 100 communicates freely by way of vents 39 in plug shell 46 to the in-situ environment, thereby leaving a path from the outside environment to openings 90 and thence through the aforementioned described system of vanes 84, 86 and gaps 91 described in FIGS 13 and 18, and finally into space 83 surrounding flexible wail 82 of receptacle end-seal 88. Thus, the in-situ pressure acts directly on flexible Wall $2 substantially balancing the pressure of the oil within receptacle chambers 79 and 77 to the in-situ pressure, One other sealing means for receptacle unit 2 when mated to plug unit 1 is provided by the slight stretch fit of each one or more shafts 7 of plug pins 26 within respective slit-shaped passages 80 in receptacle end-seal 88. Still another sealing means for receptacle unit 2 when mated to plug unit 1 is provided by the slight stretch fit of each one or more shafts 7 of plug pins 26 within respective slit-shaped passages 76 in receptacle inner chamber end-seal 73.

Figure 19A:
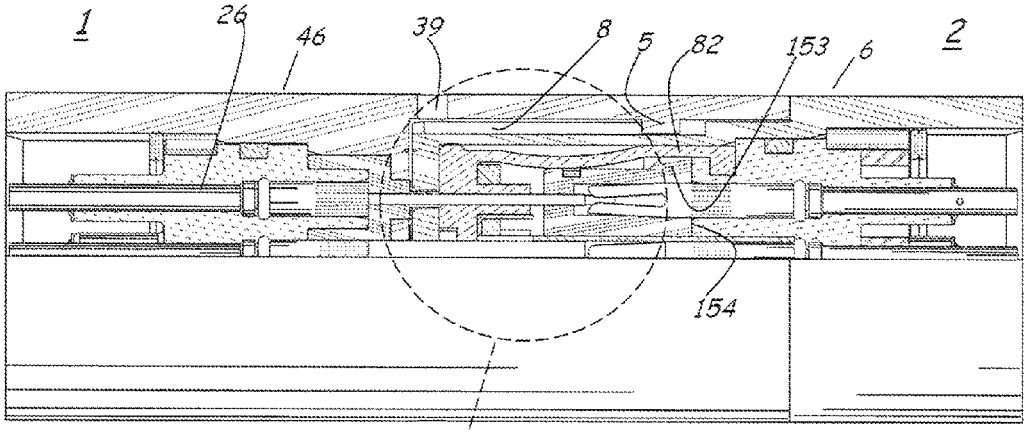
FIGS. 19*a* and 19*b* are partial axial quarter-section views of mated connector plug and receptacle units 1 and 2.
Figure 19B:
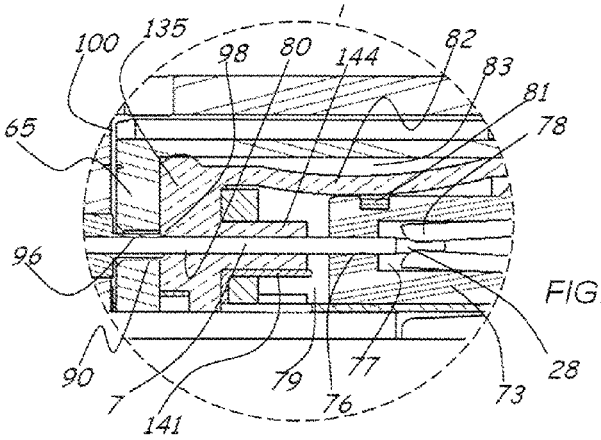

FIG. 19*a* illustrates mated connector units 1 and 2. The mating sequence is as follows: Forward projection 4 of receptacle shell 6 enters bore 3 of plug shell 46 thereby axially aligning the two connector units. With further insertion, face 65 of receptacle shell 6 encounters key 5 of plug unit 1, and can proceed no further until the mating units are rotated in such a way that key 5 enters keyway 8. The key and keyway rotationally orient the mating units. As mating continues, tips 28 of plug pin shafts 7 pass through respective openings 90 in receptacle front wall 65 and encounter respective shaped openings 98 in end wall 135 of end-seal 88 which guide them into respective slitted passages 80 of sleeves 144. As plug shaft tips 28 proceed into slitted passages 80 they overcome a slight squeeze on the outward portion of the passages that is exerted by the outward force supplied by circular spring 101, and they overcome a very light stretch of passages 83 around the exterior surfaces of plug pins 26. FIG. 13 illustrates the end-seal sleeves and passages in the unmated condition, and FIGS. 19*a* and 19*b* show them in the mated condition. As plug shafts 7 proceed further into slitted passages 80 they bend sleeves 144 radially inward from their kinked shape shown in FIG. 13 into their straightened shape shown in FIGS. 19*a* and 19*b*, simultaneously straightening tines 147 of leaf spring 148. As shafts 7 enter and proceed through slitted passages 80 they are wiped clean of any residue from the in-situ environment. Plug shafts 7 then pass through sleeves 144 and into fluid chamber 79 where they are bathed in dielectric oil. The volume of fluid displaced by entering shafts 7 is compensated by expansion of flexible wall 82 into surrounding space 83. Further insertion of shafts 7 into the receptacle unit causes conductive shaft tips 28 to overcome a slight squeeze exerted by constrictive band 81 in order to pass onward through a second set of respective slitted openings 76 in receptacle rear seal 73 where they must also overcome a very slight stretch fit within openings 76. The amount of fluid displaced in the one or more inner chambers 77 is compensated for by expansion of flexible wall portions of rear seal 73. Plug pin conductive tips 28 make contact with respective receptacle contact tines 78 within respective oil-filled chambers 77. As mating completes, forward resilient shaped nipples 96 of plug front seal 43 are conformably pressed into shaped openings 98 of receptacle end-seal 88 thereby sealing every portion of shafts 7 from the external environment, and simultaneously adding an additional level of sealing for internal oil chambers 79, 77 of receptacle unit 2.

Demating of connector units 1 and 2 proceeds in the reverse order of the mating sequence just described.

It is clear from the foregoing discussion that the invention provides a very reliable connector embodying multiple levels of protection for the electrical circuits from the in-situ environment, while doing so with an uncomplicated, and economical construction. It houses the receptacle socket contacts within nested oil chambers. The chambers have simple, independent, active closure means to keep them sealed from each other, and from the outside environment. The invention is further distinguished from prior art by the fact that every electrically conductive element of the mated plug and receptacle units is at least doubly sealed from the harsh working environment. No segments of the plug pins, for instance, are exposed to the in-situ environment when the connector units are mated. The invention permits connector units to be built in a wide range of sizes and resistant materials making them suitable for both light and heavy duty applications. Compared to prior art connectors now on the market the invention's Spartan simplicity makes it particularly adaptable for miniaturization.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A sealed electrical connector comprising:

a first unit having at least one first electrical contact including an insulated blade-like shaft with a conductive tip;

a second unit having at least one second electrical contact and having a closed chamber containing dielectric fluid therein;

the closed chamber having an end-seal comprising resilient material and having at least one slit-like opening which permits the first electrical contact to penetrate sealably into the closed chamber to electrically contact the second electrical contact wherein the slit-like opening has a linear shape when the first electrical contact is disposed therein and has a non-linear shape for urging the slit-like opening to remain sealed when the first electrical contact is not disposed therein;

a movable element disposed in the second unit to balance the fluid pressure in the closed chamber to the pressure outside the closed chamber: and active closure means to urge the slit-like opening to remain sealed.

2. The sealed electrical connector of claim 1 wherein the active closure means is a spring.

3. The sealed electrical connector of claim 2 wherein the spring is a circular spring.

4. The sealed electrical connector of claim 3 wherein the circular spring is disposed in an outer recess of the end-seal.

5. The sealed electrical connector of claim 4 wherein the outer recess of the end-seal has flat sides.

6. The sealed electrical connector of claim 5 wherein the second unit includes a bore and wherein the end-seal includes exterior nibs acting against the bore, wherein the circular spring in conjunction with the nibs acting against the bore press opposed sides of the slit-like opening together to seal the slit-like opening when the first electrical contact is not disposed in the slit-like opening.

7. The sealed electrical connector of claim 2 wherein the spring is a leaf spring having tines disposed on an interior surface of the end-seal.

8. The sealed electrical connector of claim 7 wherein the end-seal includes a resilient sleeve surrounding the slit-like opening in the end-seal and wherein the slit-like opening has a straight linear shape when the first electrical contact is disposed in the slit-like opening.

9. The sealed electrical connector of claim 8 wherein the tines of the leaf spring kink slit-like opening closed when the first electrical contact is not disposed in the slit-like opening.

10. The sealed electrical connector of claim 6 wherein the spring further comprises a leaf spring having outwardly biased tines disposed on an interior surface of the end-seal.

11. The sealed electrical connector of claim 10 wherein the end-seal includes a resilient sleeve surrounding the slit-like opening in the end-seal and wherein the slit-like opening has a straight linear shape when the first electrical contact is disposed in the slit-like opening.

12. The sealed electrical connector of claim 11 wherein the outwardly biased tines of the leaf spring kink the slit-like opening closed when the first electrical contact is not disposed in the slit-like opening.

13. The sealed electrical connector of claim 1 wherein the movable element provided to balance the fluid pressure in the closed chamber is a resilient portion of the closed chamber.

14. The sealed electrical connector of claim 13 wherein the closed chamber is an outer closed chamber, and wherein the second unit further comprises an inner closed chamber inward of the outer closed chamber, wherein the inner closed chamber contains dielectric fluid.

15. The sealed electrical connector of claim 14 wherein the second electrical contact is positioned within inner closed chamber.

16. The sealed electrical connector of claim 15 wherein the inner closed chamber has a second slit-like opening for passing the first electrical contact into the inner closed chamber from the outer closed chamber to electrically contact the second electrical contact within the inner closed chamber.

17. The sealed electrical connector of claim 1 further comprising an end wall having an opening and disposed on the second unit; a second end-seal on the first unit having a first forward projecting nipple for receiving the first electrical contact wherein the first forward projecting nipple extends through the exterior surface of the end wall of the second unit when the first and second units are mated, and wherein the second end-seal further includes a second forward projecting nipple comprising a forward projection of the first forward projecting nipple for passing through the opening in the end wall of the second unit.

18. A sealed electrical connector comprising:

a first unit having a plurality of first electrical contacts each insulated an blade-like shaft with a conductive tip;

a second unit having an outer closed chamber and an inner closed chamber, wherein the outer closed chamber and the inner closed chamber contain dielectric fluid;

a plurality of second electrical contacts positioned within the inner closed chamber;

an end wall having openings and disposed in the second unit near the first unit a second end-seal on the first unit having a plurality of first forward projecting nipples for receiving each of the respective first electrical contacts wherein each of the first forward projecting nipples cooperates with an exterior surface of the end wall of the second unit when the first and second units are mated, and wherein the second end-seal further includes second forward projecting nipples comprising a forward projection of each first forward projecting nipple for passing through the openings in the end wall of the second unit:

the outer closed chamber having an end-seal having a plurality of first slit-like openings to permit the first electrical contacts to penetrate sealably into the outer closed chamber;

a plurality of second slit-like openings in the inner closed chamber to permit the first electrical contacts to penetrate sealably into the inner closed chamber from the outer closed chamber to electrically contact the second electrical contacts within the inner closed chamber; and at least one movable element of the closed chambers to balance the fluid pressure within the inner and outer closed chambers to the pressure outside of the closed chambers.

19. The sealed electrical connector of claim 18 further comprising active closure means to urge the first slit-like openings to remain sealed.

20. The sealed electrical connector of claim 19 wherein the active closure means is a spring.

21. The sealed electrical connector of claim 19 wherein the active closure means is a constrictive band.

22. The sealed electrical connector of claim 20 wherein the spring is a circular spring.

23. The sealed electrical connector of claim 22 wherein the circular spring is disposed in an outer recess of the end-seal.

24. The sealed electrical connector of claim 23 wherein the outer recess of the end-seal has flat sides.

25. The sealed electrical connector of claim 24 wherein the second unit includes a bore and wherein the end seal includes exterior nibs acting against the bore, wherein the circular spring in conjunction with the nibs acting against the bore press opposed sides of the first slit-like openings together to seal the first slit-like openings when the first electrical contacts are not disposed in the first slit-like openings.

26. The sealed electrical connector of claim 20 wherein the spring is a leaf spring having outwardly biased tines disposed on an interior surface of the end-seal.

27. The sealed electrical connector of claim 26 wherein the end-seal includes a resilient sleeve surrounding each of the first slit-like openings in the end-seal, wherein each first slit-like opening has a straight linear shape when the first electrical contacts are disposed in the first slit-like openings.

28. The sealed electrical connector of claim 27 wherein the outwardly biased tines of the leaf spring kink the first slit-like openings closed when the first electrical contacts are not disposed in the first slit-like openings.

29. The sealed electrical connector of claim 19 wherein the at least one movable element to balance the fluid pressure within the closed chambers comprises at least one resilient portion of the closed chambers.

30. The sealed electrical connector of claim 29 further comprising active closure means to urge the first slit-like openings to remain sealed.

31. The sealed electrical connector of claim 30 wherein the active closure means is a constrictive band.

32. A sealed electrical connector comprising:

a first unit having a plurality of first electrical contacts each including an insulated blade-like shaft with a conductive tip;

a second unit having a closed chamber containing dielectric fluid therein;

a plurality of second electrical contacts positioned within the closed chamber;

an end wall having openings and disposed in the second unit for passing the first electrical contacts into the second unit;

a first end-seal on the first unit having a plurality of first forward projecting nipples for receiving the first electrical contacts, and wherein the first end-seal further includes a plurality of second forward projecting nipples each comprising a forward projection of a first forward projecting nipple for passing through openings in the end wall of the second unit; and a movable element of the closed chamber to balance the fluid pressure within the closed chamber to the pressure outside of the closed chamber.

33. The sealed electrical connector of claim 32 wherein the closed chamber comprises a second end-seal comprising resilient material and having a plurality of sealable slit-like openings extending into the closed chamber for passing the first electrical contacts into the closed chamber to electrically contact the second electrical contacts.

34. The sealed electrical connector of claim 33 further comprising active closure means to urge the slit-like openings to remain sealed.

35. The sealed electrical connector of claim 34 wherein the active closure means is a spring.

36. The sealed electrical connector of claim 35 wherein the spring is a circular spring.

37. The sealed electrical connector of claim 36 wherein the circular spring is disposed in an outer recess of the second end-seal.

38. The sealed electrical connector of claim 37 wherein the outer recess of the second end-seal has flat sides.

39. The sealed electrical connector of claim 38 wherein the second unit includes a bore and wherein the second end-seal includes exterior nibs acting against the bore, wherein the circular spring in conjunction with the nibs acting against the bore press opposed sides of the slit-like openings together to seal the slit-like openings when the first electrical contacts are not disposed in the slit-like openings.

40. The sealed electrical connector of claim 35 wherein the spring is a leaf spring having outwardly biased tines disposed on an interior surface of the second end-seal.

41. The sealed electrical connector of claim 40 wherein the second end-seal includes a resilient sleeve surrounding each of the slit-like openings in the second end-seal, and wherein each slit-like opening has as straight, linear shape when the first electrical contacts are disposed therein.

42. The sealed electrical connector of claim 41 wherein the outwardly biased tines of the leaf spring kink respective slit-like openings closed when the first electrical contacts are not disposed in the slit-like openings.

43. The sealed electrical connector of claim 39 further comprising a leaf spring having outwardly biased tines disposed on an interior surface of the second end-seal.

44. The sealed electrical connector of claim 43 wherein the second end-seal includes a resilient sleeve surrounding each of the slit-like openings in the second end-seal, and wherein each slit-like opening has a straight, linear shape when the first electrical contacts are disposed therein.

45. The sealed electrical connector of claim 44 wherein the outwardly biased tines of the leaf spring kink the slit-like openings closed when the first electrical contacts are not disposed in the slit-like openings.

46. The sealed electrical connector of claim 32 wherein the movable element to balance the fluid pressure within the closed chamber to the pressure outside the closed chamber is a resilient portion of the closed chamber.

47. The sealed electrical connector of claim 32 wherein the closed chamber is an outer closed chamber, and wherein the second unit further comprises an inner closed chamber inward of the outer closed chamber, and wherein the inner closed chamber contains dielectric fluid.

48. The sealed electrical connector of claim 47 wherein the second electrical contacts are positioned within the inner closed chamber.

49. The sealed electrical connector of claim 48 wherein the outer chamber comprises a resilient body having a plurality of second slit-like openings to permit the respective first electrical contacts to penetrate sealably into the inner closed chamber from the outer closed chamber to electrically contact the second electrical contacts within the inner closed chamber.

50. The sealed electrical connector of claim 47 wherein the fluid pressure within the inner closed chamber is balanced to the pressure outside the inner closed chamber by a movable element of the closed chambers.

51. The sealed electrical connector of claim 50 wherein the movable element is a resilient portion of the inner closed chamber.

* * * * *